US008826462B2

(12) United States Patent
Storms, Jr. et al.

(10) Patent No.: US 8,826,462 B2
(45) Date of Patent: Sep. 9, 2014

(54) RELEASABLE VEST

(75) Inventors: Frederick W. Storms, Jr., Newport News, VA (US); Eric M. Yeates, Virginia Beach, VA (US); Thomas A. Marx, Virginia Beach, VA (US); Marty Goldman, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 497 days.

(21) Appl. No.: 12/733,011

(22) PCT Filed: Nov. 3, 2008

(86) PCT No.: PCT/US2008/012420

§ 371 (c)(1),
(2), (4) Date: Apr. 22, 2010

(87) PCT Pub. No.: WO2009/096933

PCT Pub. Date: Aug. 6, 2009

(65) Prior Publication Data

US 2010/0287681 A1 Nov. 18, 2010

Related U.S. Application Data

(60) Provisional application No. 61/001,435, filed on Nov. 1, 2007.

(51) Int. Cl.
*F41H 1/02* (2006.01)

(52) U.S. Cl.
CPC ..... *F41H 1/02* (2013.01)
USPC ..... 2/2.5; 2/102

(58) Field of Classification Search
USPC ..... 2/102, 462, 463, 464, 465, 467, 2.5
See application file for complete search history.

(56) References Cited

U.S. PATENT DOCUMENTS

| | | | | |
|---|---|---|---|---|
| 1,776,044 | A * | 9/1930 | Roehm | 2/52 |
| 3,557,384 | A * | 1/1971 | Barron | 2/2.5 |
| 4,262,865 | A * | 4/1981 | Smith | 244/151 A |
| 4,497,069 | A * | 2/1985 | Braunhut | 2/2.5 |
| 4,697,285 | A * | 10/1987 | Sylvester | 2/2.5 |
| 5,060,314 | A * | 10/1991 | Lewis | 2/2.5 |
| 5,259,093 | A * | 11/1993 | D'Annunzio | 24/3.9 |
| 5,516,234 | A * | 5/1996 | Duchesne | 405/186 |
| 5,724,707 | A * | 3/1998 | Kirk et al. | 24/3.7 |
| 6,164,048 | A * | 12/2000 | Rhodes | 54/1 |
| 6,185,738 | B1 * | 2/2001 | Sidebottom | 2/2.5 |
| 6,421,833 | B2 * | 7/2002 | Khanamirian et al. | 2/69 |
| 6,769,137 | B2 * | 8/2004 | D'Annunzio | 2/102 |

(Continued)

*Primary Examiner* — Khoa Huynh
*Assistant Examiner* — Andrew W Collins
(74) *Attorney, Agent, or Firm* — Shaddock Law Group, PC

(57) ABSTRACT

A releasable vest having a front panel; front shoulder strap elements that include at least one front shoulder strap attachment opening; a back panel; a first waist belt element that extends from the front panel and has at least one waist belt element attachment opening formed through the waist belt element; a second waist belt element that extends from the front panel and has at least one release loop attached thereto, wherein the at least one release loop is capable of being passed through the waist belt attachment opening of the first waist belt element and the at least one front shoulder strap attachment opening of the front shoulder strap elements; and a release lanyard that is capable of being passed through the release loop so as to releasably secure the first waist belt element and the at least one shoulder strap element to the release loop.

19 Claims, 11 Drawing Sheets

(56) References Cited

U.S. PATENT DOCUMENTS

| | | | | |
|---|---|---|---|---|
| 6,948,188 | B2 * | 9/2005 | D'Annunzio | 2/102 |
| 7,020,897 | B2 * | 4/2006 | Johnson | 2/102 |
| 7,047,570 | B2 * | 5/2006 | Johnson | 2/102 |
| 7,080,430 | B2 * | 7/2006 | Wemmer | 24/578.13 |
| 7,424,748 | B1 * | 9/2008 | McDunn et al. | 2/2.5 |
| 7,490,358 | B1 * | 2/2009 | Beck | 2/2.5 |
| 7,987,523 | B2 * | 8/2011 | Cole et al. | 2/102 |
| 2005/0005342 | A1 * | 1/2005 | Johnson | 2/102 |
| 2005/0005343 | A1 * | 1/2005 | Johnson | 2/102 |
| 2005/0015837 | A1 * | 1/2005 | Saito | 2/2.5 |
| 2010/0287681 | A1 * | 11/2010 | Storms et al. | 2/102 |

* cited by examiner

RELEASABLE VEST

CROSS-REFERENCE TO RELATED APPLICATIONS

This patent application claims the benefit of U.S. Patent Application Ser. No. 61/001,435, filed Nov. 1, 2007, the disclosure of which is incorporated herein by reference.

BACKGROUND OF THE INVENTION

1. Field of the Invention

This invention relates generally to releasable vests or carriers. In particular, the present invention relates to an improved releasable vest or carrier that is easier to operate and has components that, upon release by a user, are more likely to separate and fall away from the user than current releasable or cutaway vests.

2. Description of Related Art

Military and law enforcement personnel, particularly those attached to special operations unit, carry a large amount of specially designed and adapted gear on various vests or carriers. Because of the bulk and weight of certain tactical vests and body armor carriers, it is sometimes necessary or desirable to be able to quickly remove the vest or carrier, particularly in an emergency situation.

SUMMARY OF THE INVENTION

However, current releasable or cutaway vests typically include a multitude of components or panels that are connected via a plurality of release cords that are intricately woven between the components in order to keep the components connected.

In order for the various components or panels of a known, assembled cutaway vest to be released, the wearer must pull the release cord(s) a sufficient distance such that the release cord(s) becomes unwoven from the various components and releases each of the components. This is typically difficult as there is a great deal of friction between the release cord(s) and the cutaway vest components. Furthermore, the release cord (s) typically have to be pulled a great distance in order to fully release the cutaway vest components.

The release cord(s) typically comprise metal or plastic cords with a circular cross-section. While cords having a circular cross-section may be used, if a load is placed on the vest in an area above the location of one of the cords, a pressure point can be formed, making the vest uncomfortable for the wearer of the vest.

In many of the current cutaway vests, even after the release cord(s) have been removed from the vest, the vest components remain firmly coupled to one another via various large attachment areas, such as large portions of Velcro. Thus, the "released" components still remain firmly coupled to one another and must still be forcibly, manually separated from one another before the cutaway vest can be removed from the user.

Therefore, the present invention relates generally to releasable vests or carriers that are easier for a user to operate and have components that, upon release, are more likely to separate and fall away from the user than current cutaway vests.

In various exemplary, non-limiting embodiments, the releasable vest or carrier comprises at least some of a front panel, a back panel, and at least one waist belt element extending from or coupled to either the front panel or the back panel. A flexible release lanyard is used in combination with a release loop, such that when various components of the releasable vest or carrier are assembled, the components can be maintained in an assembled relationship. When the flexible release lanyard is pulled a predetermined distance, select components of the releasable vest or carrier are released from the assembled relationship and can fall away from the user.

In various exemplary, non-limiting embodiments, an additional safety lanyard may be included. In these exemplary embodiments, at least some of the components of the releasable vest or carrier cannot be released from the assembled relationship until both the safety lanyard and the release lanyard are pulled a predetermined distance.

Accordingly, this invention provides a releasable vest of improved design.

This invention separately provides a vest, which is capable of allowing a user to more efficiently release, or "cut away", the vest.

This invention separately provides a releasable vest, which, in certain exemplary embodiments, is capable of providing an increased level of security against accidental release.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
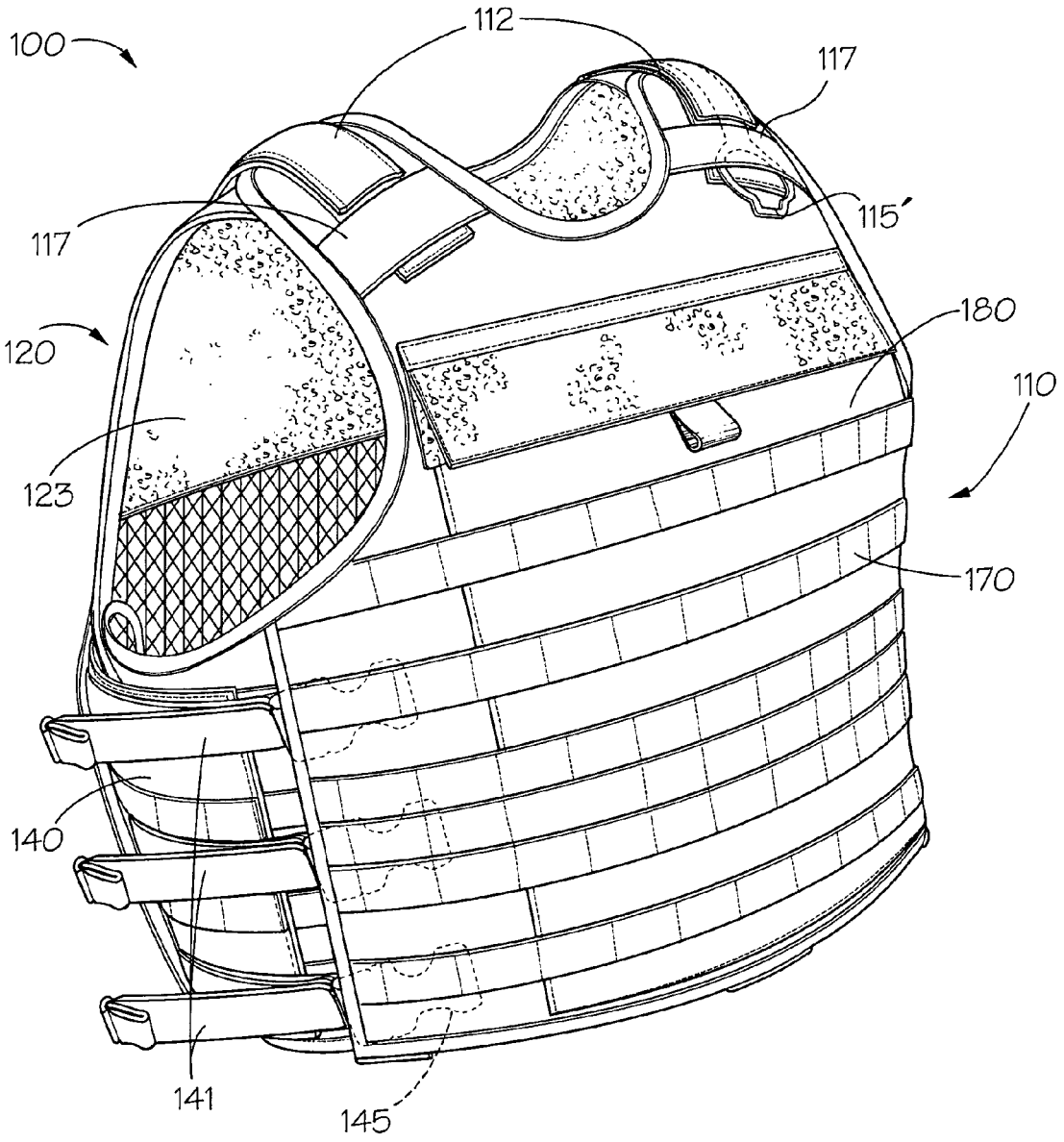
FIG. 1 shows a front perspective view of a first exemplary embodiment of a releasable vest according to this invention.
Figure 2:
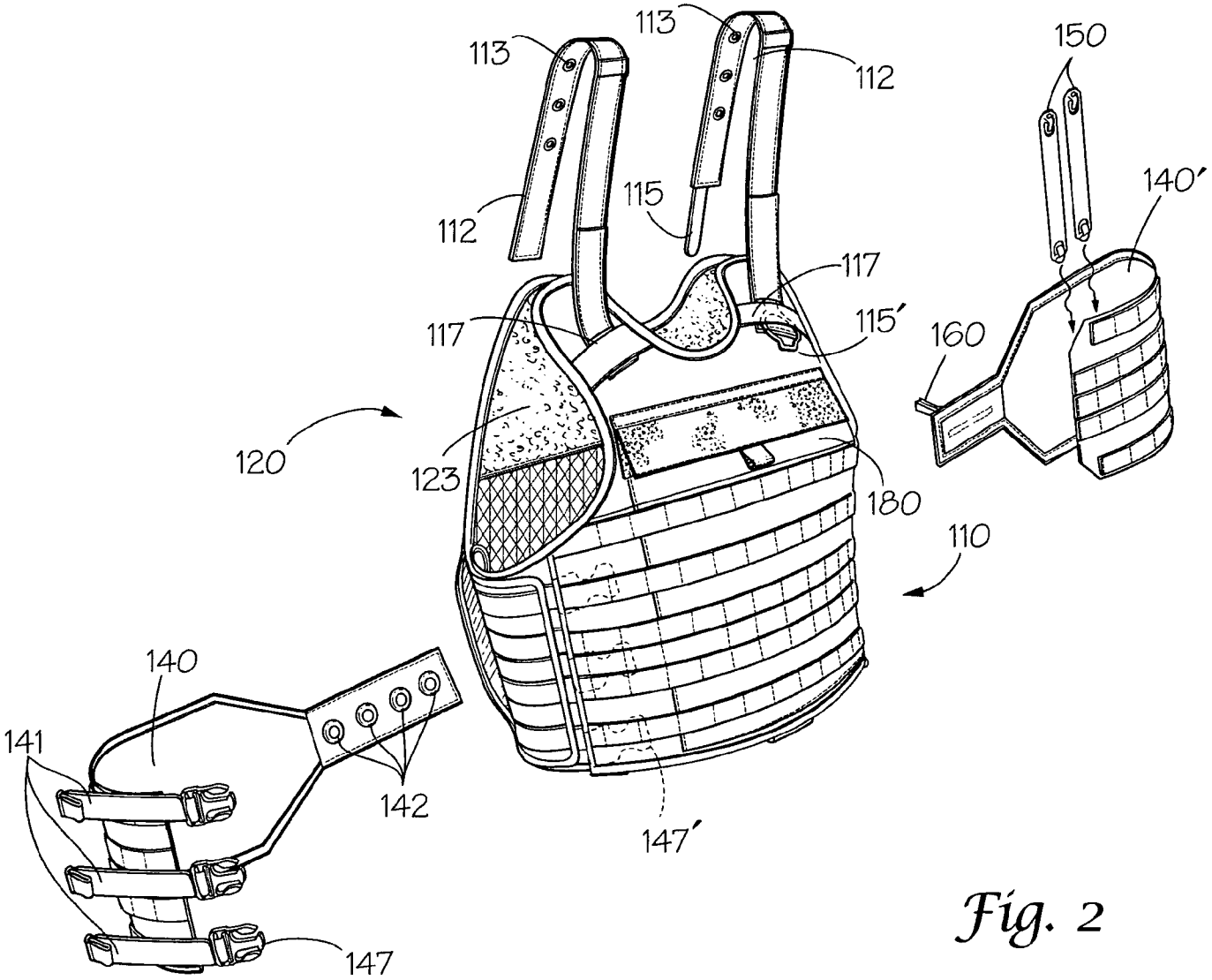
FIG. 2 shows an exploded front perspective view of a first exemplary embodiment of a releasable vest according to this invention.

For simplicity and clarification, the design factors and operating principles of the releasable vest of this invention are explained with reference to various exemplary embodiments of a releasable vest. The basic explanation of the design factors and operating principles of the releasable vest is applicable for the understanding, design, and operation of the releasable vest of this invention.

It should also be appreciated that, for simplicity and clarification, the embodiments of this invention will be described using the terms "front" and "back". However, it should be understood that these terms are merely used to aid in understanding of this invention are not to be construed as limiting the systems, methods, and apparatuses of this invention. Thus, it should be appreciated that the design factors and operating principles of the releasable vest described herein may be used in a "mirror image" releasable vest, where in the elements described as being included in or on the front are included in or on the back. Alternatively certain of the elements that are described as being included in or on the back of the releasable vast may be included in or on the front of the vest, or vice versa.

Furthermore, it should be appreciated that, for simplicity and clarification, the embodiments of this invention will be shown and/or described with reference to MOLLE and/or S.T.R.I.K.E. compatible webbing being included on various portions of the releasable vest. However, it should be appreciated that the inclusion and/or placement of any MOLLE and/or S.T.R.I.K.E. compatible webbing is not essential to the releasable vest of this invention. In various exemplary, non-limiting embodiments of this invention, the releasable vest may incorporate any type of known or later developed system capable of allowing any number of exterior pouches, pockets, carriers, or the like to be permanently or releasably coupled or attached to the vest. Alternatively, the design factors and principles of this invention may be utilized in a vest that does not include any exterior pouches, pockets, or carriers, but is used as, for example, a ballistic plate carrier or a floatation device.

It should also be appreciated that the terms "releasable vest", "vest", and "carrier" are used for basic explanation and understanding of the operation of the systems, methods, and apparatuses of this invention. Therefore, the terms "releasable vest", "vest", and "carrier" are not to be construed as limiting the systems, methods, apparatuses, and applications of this invention.

Turning now to the drawing figures, FIGS. 1 through 10B show various features of a first exemplary embodiment of a releasable vest according to this invention. As shown in the drawing figures, the releasable vest 100 includes at least some of a front panel 110, front shoulder strap elements 112, a back panel 120, a waist belt element 140, a waist belt element 140', a release loop 160, and a release lanyard 115.

The front panel 110 comprises at least a first layer 111 and a second layer 114, with a cavity formed between the first layer 111 and the second layer 114. An upper portion of the second layer 114 is attached or coupled to the first layer 111 at an upper portion of the first layer 111. In various exemplary embodiments, as illustrated herein, a lower portion of the second layer 114 extends beyond a point where the second layer 114 is attached or coupled to the first layer 111 to form a front panel flap portion 114' of the second layer 114.

The front panel flap portion 114' is formed so as to be secured or releasably coupled to the first layer 111 by a releasable coupling means 116. In various exemplary embodiments, the releasable coupling means 116 may comprise a hook and loop fastener, such as Velcro. It should be appreciated that, in various exemplary embodiments the releasable coupling means 116 may comprise other releasable coupling means or releasable fasteners, such as, for example, male/female snap-release buckles, a ziplock fastening device, a zipper, buttons, snaps, or other fastening, closure, or attachment means known by those skilled in the art.

In various exemplary embodiments, as illustrated herein, the front panel flap portion 114' may be formed so as to extend beyond a lower portion of the first layer 111 and be releasably coupled to a first side of the first layer 111 (a side of the front panel 110 that faces towards the body of a user wearing the releasable vest 100). Alternatively, the front panel flap portion 114' may be formed so as to be releasably coupled to a second side of the first layer 111 (a side of the front panel 110 that faces away from the body of a user wearing the releasable vest 100).

In various exemplary embodiments, the front panel 110 may also comprise an additional layer of material 122, which provides an additional cushioning or airflow layer to the front panel 110. Furthermore, the front panel 110 may comprise a portion of attachment material 123, such as, for example, a hook and loop fastener, such as Velcro. The inclusion of a portion of attachment material 123 may allow for the releasable attachment of certain additional components, such as, for example, collars or other protective portions, to the front panel 110 of the releasable vest 100.

The front panel 110 includes two front shoulder strap elements 112 that extend from an upper portion of the front panel 110. In various exemplary embodiments, the front shoulder strap elements 112 are formed as an integral part of the front panel 100. Alternatively, the front shoulder strap elements 112 may be coupled or attached to the front panel 110.

In various exemplary embodiments, each of the front shoulder strap elements 112 includes a plurality of front shoulder strap attachment openings 113. In various exemplary, non-limiting embodiments, the front shoulder strap attachment openings 113 comprise slits or openings formed through the material of the front shoulder strap elements 112.

In certain exemplary embodiments, the attachment openings 113 are reinforced by, for example, stitching, a grommet, or other reinforced eyelet.

The front shoulder strap attachment openings 113 allow the release loop 160 to pass through the front shoulder strap elements 112 (as discussed below). In various exemplary embodiments, a single attachment opening 113 may be included on each front shoulder strap element 112. However, a plurality of attachment openings 113 may be included to allow a user to select a single attachment opening 113 to pass the release loop 160 through, thereby providing a measure of adjustment to the effective length of the front shoulder strap elements 112 and the overall fit of the releasable vest 100.

Figure 6:
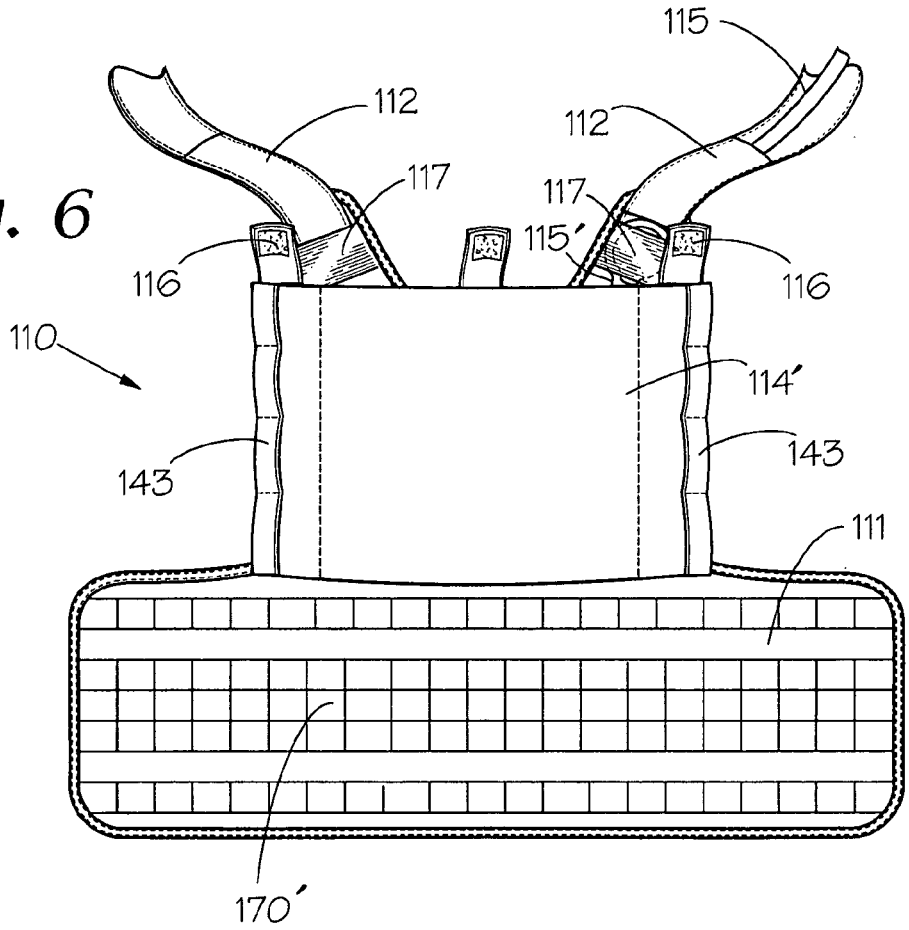
FIG. 6 shows a front view of the front panel of the releasable vest, illustrating a front panel flap in an open position.
Figure 7:
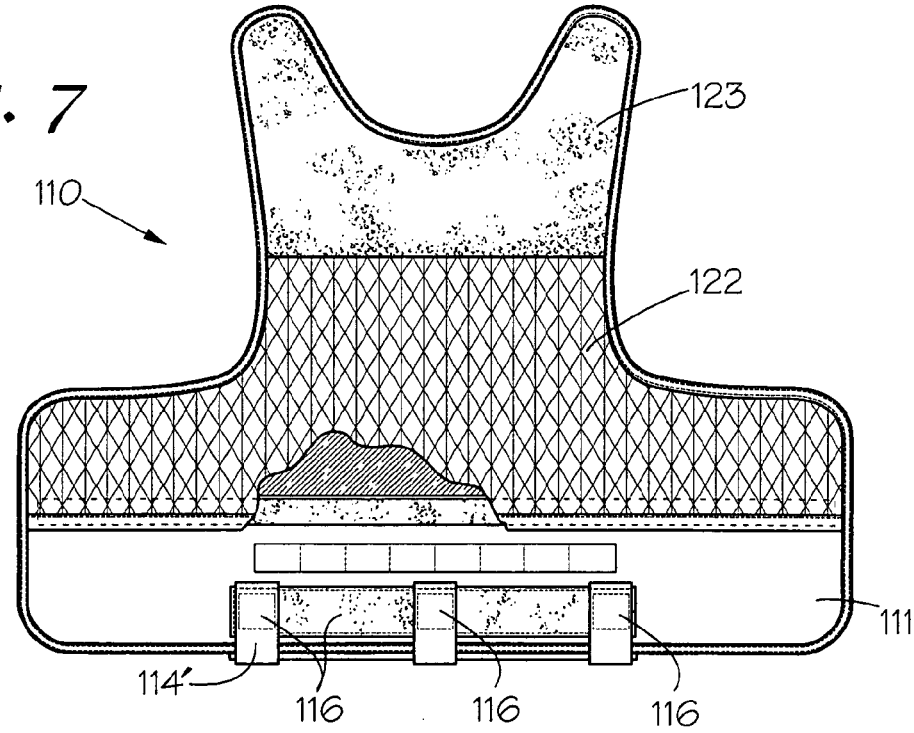
FIG. 7 shows a rear view of the front panel of the releasable vest, illustrating the front panel flap in a closed position.
Figure 8:
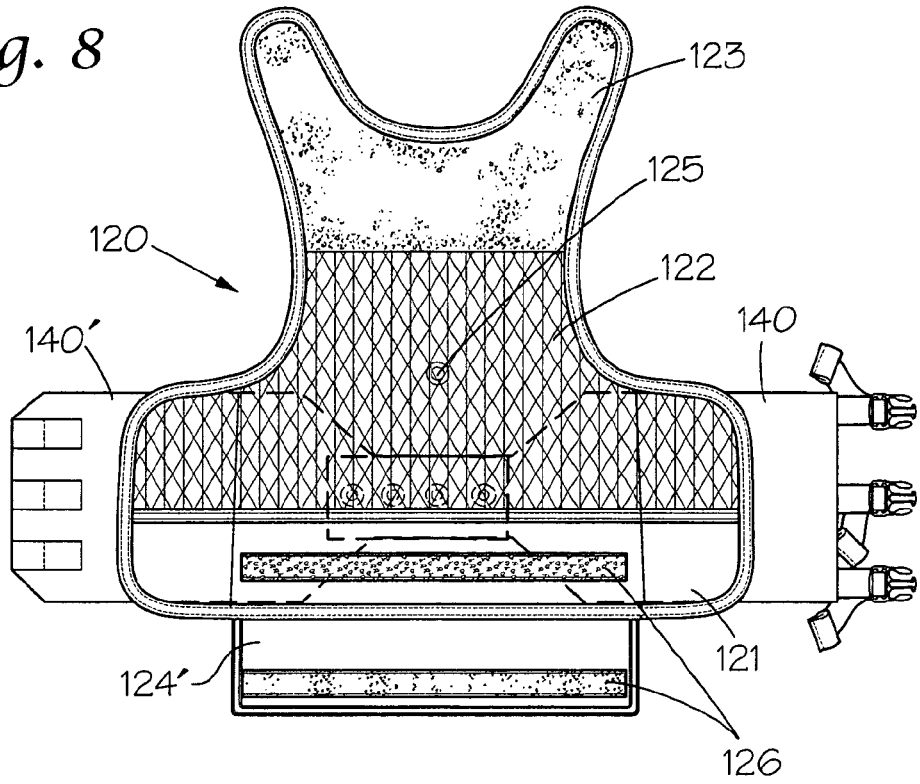
FIG. 8 shows a rear view of the back panel of the releasable vest, illustrating a back panel flap in a partially open position.

In various exemplary embodiments, a MOLLE and/or S.T.R.I.K.E. compatible accessory mounting portion 170' is included on the second side of the first layer 111. It should be appreciated that, as illustrated in FIG. 6, the accessory mounting portion 170' may also be provided in an area of the first layer 111 that is capable of being covered by the front panel flap portion 114' of the second layer 114.

Additionally, a MOLLE and/or S.T.R.I.K.E. compatible accessory mounting portion 170 is included on the second side of the second layer 114.

The back panel 120 comprises at least a first layer 121 and a second layer 124, with a cavity formed between the first layer 121 and the second layer 124. An upper portion of the second layer 124 is attached or coupled to the first layer 121 at an upper portion of the first layer 121. In various exemplary embodiments, as illustrated herein, a lower portion of the second layer 124 extends beyond a point where the second layer 124 is attached or coupled to the first layer 121 to form a back panel flap portion 124' of the second layer 124.

In various exemplary embodiments, a grommet 125 or other coupling means is positioned so as to provide additional coupling of the first layer 121 to the second layer 124. It should be appreciated that, in various exemplary embodiments, the grommet 125 may be replaced by other permanent or releasable coupling means fasteners, such as, for example, a stitch or stitched portion, one or more male/female snap-release buckles, one or more buttons, snaps, or other fastening, closure, or attachment means known to those skilled in the art.

The back panel flap portion 124' of the second layer 124 is formed so as to be secured or releasably coupled to the first layer 121 by a releasable coupling means 126. In various exemplary embodiments, the releasable coupling means 126 may comprise a hook and loop fastener, such as Velcro. It should be appreciated that, in various exemplary embodiments the releasable coupling means 126 may comprise other releasable coupling means or releasable fasteners, such as, for example, male/female snap-release buckles, a ziplock fastening device, a zipper, buttons, snaps, or other fastening, closure, or attachment means known by those skilled in the art.

In various exemplary embodiments, as illustrated herein, the back panel flap portion 124' may be formed so as to extend beyond a lower portion of the first layer 121 and be releasably coupled to a first side of the first layer 121 (a side of the back panel 120 that faces towards the body of a user wearing the releasable vest 100). Alternatively, the back panel flap portion 124' may be formed so as to be releasably coupled to a second side of the first layer 121 (a side of the back panel 120 that faces away from the body of a user wearing the releasable vest 100).

In various exemplary embodiments, the back panel 120 may also comprise an additional layer of material 122, which provides an additional cushioning or airflow layer to the back panel 120. Furthermore, the back panel 120 may comprise a portion of attachment material 123, such as, for example, a hook and loop fastener, such as Velcro. The inclusion of a portion of attachment material 123 may allow for the releasable attachment of certain additional components, such as, for example, collars or other protective portions, to the back panel 120 of the releasable vest 100.

The back panel 120 comprises a cavity or tunnel formed between at least a portion of the first layer 121 and the second layer 124. In this manner, at least a portion of the front shoulder strap elements 112 can be introduced into an interior of the back panel 120 formed between at least a portion of the first layer 121 and the second layer 124.

The waist belt elements 140 and 140' serve to couple the front panel 110 to the back panel 120. As illustrated in the drawing figures, the waist belt element 140 is releasably coupled or attached to the first layer 111 of the front panel 110, via waist belt attachment/adjustment elements 145.

Each of the waist belt attachment/adjustment elements 145 comprises a mating pair of coupling elements, a male coupling element 147 and a corresponding female coupling element 147', proximate a first end of the waist belt element 140. The male coupling element 147 and the female coupling element 147' may be releasably coupled together.

The female coupling element 147' is releasably or permanently coupled or attached to the first layer 111 of the front panel 110, while the male coupling element 147 is releasably or permanently coupled or attached to the waist belt element 140. In this manner, when the male coupling element 147 and the female coupling element 147' are coupled, the front panel 110 is coupled to the waist belt element 140.

In various exemplary embodiments, each of the male coupling elements 147 is secured to an extended web portion of the MOLLE and/or S.T.R.I.K.E. compatible accessory mounting portion 144 of the waist belt element 140 that forms a strap element 141.

In various exemplary embodiments, an excess portion of the strap element 141 can be releasably secured under a strap-securing element 143. In various exemplary embodiments, the strap securing element 143 comprises a length of flexible or elastic webbing, which is attached to a first side of the front panel flap portion 114' of the second layer 114. The excess portion of the strap element 141 can be woven between the front panel flap portion 114' of the second layer 114 and the strap-securing element 143.

As illustrated herein, each of the female coupling elements 147' is secured to a MOLLE and/or S.T.R.I.K.E. compatible accessory mounting portion 170' of the first layer 111 of the front panel 110. In various exemplary embodiments, the female coupling element 147' may be removably attachable to a MOLLE and/or S.T.R.I.K.E. compatible accessory mounting portion 170' through use of an attachment opening (not shown). If included, the attachment opening (not shown) allows the female coupling element 147' to be secured to a portion of the webbing of the MOLLE and/or S.T.R.I.K.E. compatible accessory mounting portion 170', after the webbing has been secured to the first layer 111 of the front panel 110.

As illustrated herein, the waist belt element 140 comprises a sufficient length of strap element 141 and includes appropriate hardware such that the effective length of the waist belt element 140 relative to the front panel 110 may be adjusted to provide an additional measure of adjustment to the overall fit of the releasable vest 100.

It should be appreciated that, although the waist belt element 140 is shown as being secured to the first layer 111 via waist belt attachment/adjustment elements 145, the waist belt element 140 may be removably or permanently secured to the first layer 111 via any known or later developed means for securing the waist belt element 140 to the first layer 111. For example, the waist belt element 140 may be secured to the first layer 111 via male/female snap-release buckles, Velcro or other hook-and-loop fasteners, buttons, rivets, snaps, or other known or later developed fastening means.

In various exemplary embodiments, not illustrated herein, the strap element 141 may be of a predetermined length and/or the waist belt element 140 may be formed as an integral part of the first layer 111 and merely extend from the first layer 111. In these exemplary embodiments, at least a portion of the integral waist belt element and/or the strap element may include a flexible or elastic portion to allow for a measure of expansion of the waist belt element so that the waist belt element can expand to make the releasable vest 100 easier for a user to don.

As further illustrated in the drawing figures, the waist belt element 140' is releasably coupled or attached to the first layer 111 of the front panel 110, via one or more coupling member 150.

Figures 3A, 3B:
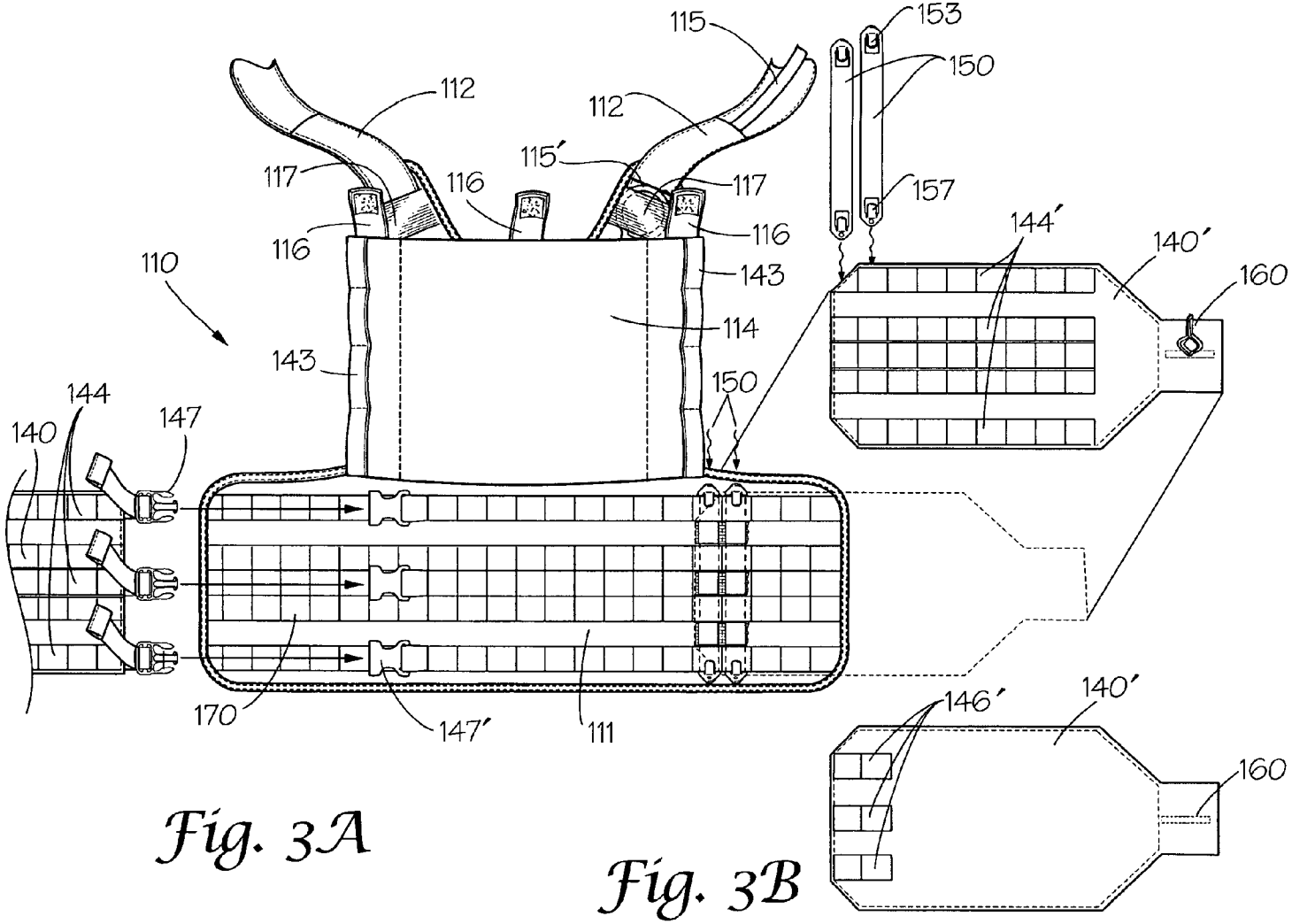
FIG. 3A shows a partially exploded front view of a first exemplary embodiment of a releasable vest, illustrating a front panel flap in an open position, according to this invention.
FIG. 3B shows a rear view of an exemplary waist belt element of the present invention.

Each coupling member 150 comprises an elongate portion of material having a first end portion 152, an intermediate portion 155, and a second end portion 156. As illustrated in FIG. 3A, a hook 153 is formed integral to a portion of the first end portion 152 and a hook 157 is formed integral to a portion of the second end portion 156.

In various exemplary, non-limiting embodiments, the coupling member 150 comprises a coupling member as described in U.S. patent application Ser. No. 11/703,882, entitled Modular Equipment Coupler, filed Feb. 8, 2007, the disclosure of which is incorporated herein by reference.

Figure 4:
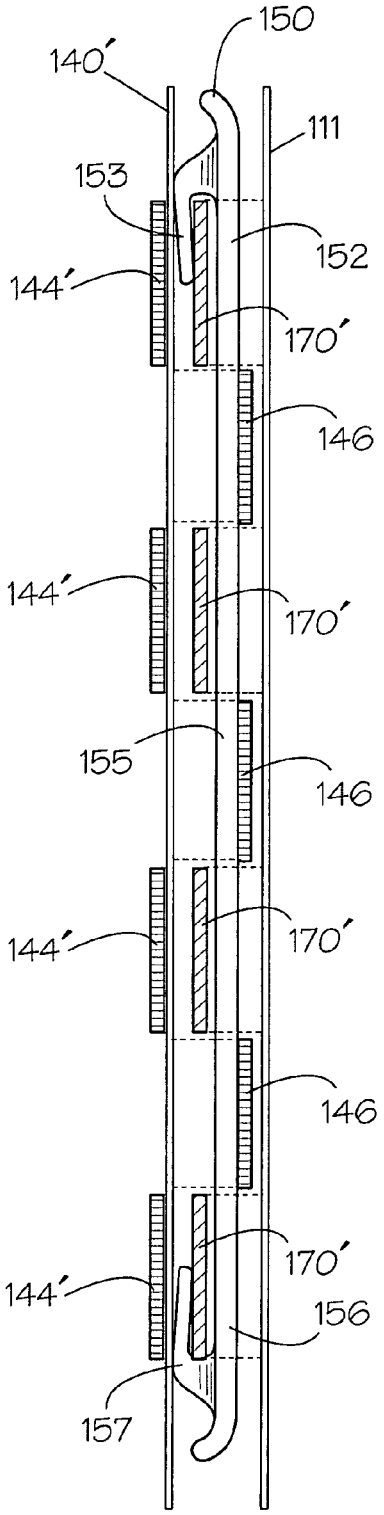
FIG. 4 shows a cross sectional view of an exemplary embodiment of a coupling member used to removably attach a waist belt element to the front panel, according to this invention.

As illustrated in FIGS. 3A and 4, the waist belt element 140' is coupled to the first layer 111 of the front panel 110, via the accessory mounting portion 170'. In order to couple the waist belt element 140' to the front panel 110, the waist belt element 140' is placed adjacent the accessory mounting portion 170', such that waist belt webbings 146' are within the spaces between spaced apart accessory mounting portions 170' (and the accessory mounting portions 170' are within spaces between the spaced apart waist belt webbings 146') and corresponding panel tunnel segments and waist belt tunnel segments are aligned, the coupling member 150 may be interwoven between the aligned panel tunnel segments and waist belt tunnel segments to removably couple the waist belt element 140' to the accessory mounting portion 170'.

In various exemplary embodiments, when the coupling member 150 has been laced through an initial panel tunnel segment, the coupling member 150 is then laced through an initial waist belt tunnel segment. When the coupling member 150 has been laced through the initial waist belt tunnel segment, the coupling member 150 is then laced through a subsequent corresponding panel tunnel segment. When the coupling member 150 has been laced through the subsequent corresponding panel tunnel segment, the coupling member 150 is then laced through a subsequent corresponding waist belt tunnel segment.

The coupling member 150 continues to be interlaced between the corresponding waist belt tunnel segments and panel tunnel segments, as described above, until either the entire coupling member 150 has been interlaced between the corresponding carrier and waist belt tunnel segments or a last panel tunnel segment or waist belt tunnel segment has been utilized, as illustrated in FIG. 4. As the coupling member 150 is laced through the corresponding carrier and waist belt tunnel segments, the waist belt element 140' is drawn towards and removably coupled to the accessory mounting portion 170'.

As described above, the coupling member 150 is first laced through an initial panel tunnel segment. However, it should be appreciated that, in various exemplary embodiments, the coupling member 150 may first be laced through an initial waist belt tunnel segment.

Once the coupling member 150 has been interlaced between the corresponding waist belt tunnel segments and panel tunnel segments, the hook 157 is placed around a last accessory mounting portion 170' to further secure the coupling member 150 within the waist belt tunnel segments and panel tunnel segments. It should be appreciated that once the coupling member 150 has been interlaced between the corresponding waist belt tunnel segments and panel tunnel segments, the hook 157 may alternatively be placed around a last waist belt webbings 146'.

Once the coupling member 150 has been interlaced between the corresponding waist belt tunnel segments and panel tunnel segments, the hook 153 is placed around a first accessory mounting portion 170' to further secure the coupling member 150 within the waist belt tunnel segments and panel tunnel segments. It should be appreciated that once the coupling member 150 has been interlaced between the corresponding waist belt tunnel segments and panel tunnel segments, the optional hook 153 may alternatively be placed around a first waist belt webbings 146'.

While the coupling member 150 has been described as being interlaced between the corresponding waist belt tunnel segments and panel tunnel segments, such that both a first end portion 152 and a second end portion 156 of the coupling member 150 are removably secured to a last waist belt webbings 146' and a first waist belt webbings 146', respectively (or a last accessory mounting portion 170' and a first accessory mounting portion 170', respectively), the coupling member 150 may be formed so as to allow the first end portion 152 to be removably secured to an waist belt webbings 146' and the second end portion 156 to be removably secured to a accessory mounting portion 170', or vice versa.

Thus, while the coupling members 150 are illustrated as being interlaced through four accessory mounting portions 170' and three waist belt webbings 146', it should also be appreciated that the coupling member 150 may be interlaced through any number of accessory mounting portions 170' and waist belt webbings 146'.

It should be understood that since the total number of spaced apart accessory mounting portions 170' and spaced apart waist belt webbings 146' may vary, the total length of the coupling member 150 may vary.

It should be appreciated that, although the waist belt element 140' is shown as being secured to the first layer 111 via coupling members 150, the waist belt element 140' may be removably or permanently secured to the first layer 111 via any known or later developed means for securing the waist belt element 140' to the first layer 111. For example, the waist belt element 140' may be secured to the first layer 111 via male/female snap-release buckles, Velcro or other hook-and-loop fasteners, buttons, rivets, snaps, or other known or later developed fastening means.

In various exemplary embodiments, not illustrated herein, the waist belt element 140' may be formed as an integral part of the first layer 111 and merely extend from the first layer 111. In these exemplary embodiments, at least a portion of the integral waist belt element may include a flexible or elastic portion to allow for a measure of expansion of the waist belt element so that the waist belt element can expand to make the releasable vest 100 easier for a user to don.

In various exemplary embodiments, the release loop 160 is attached or coupled to one of the waist belt element 140 or the waist belt element 140'. In various exemplary embodiments, the release loop 160 comprises a loop made of a fabric, metallic, plastic, or composite material.

The other of the waist belt element 140 or the waist belt element 140', which does not include or accommodate the release loop 160, includes one or more waist belt attachment opening(s) 142.

For simplicity of explanation, the releasable vest 100 is described as having the release loop 160 is attached or coupled to the waist belt element 140' and the one or more waist belt attachment opening(s) 142 included in the waist belt element 140.

In these exemplary, non-limiting embodiments, the waist belt attachment opening(s) 142 comprise slits or openings formed through the material of the waist belt element 140. In certain exemplary embodiments, the waist belt attachment opening(s) 142 are reinforced by, for example, stitching, a grommet, or other reinforced eyelet.

The waist belt attachment opening(s) 142 allow the release loop 160 to pass through the waist belt element 140 (as discussed below). In various exemplary embodiments, a single attachment opening 142 may be included on each waist belt attachment opening 142. However, a plurality of waist belt attachment opening(s) 142 may be included to allow a user to select a single waist belt attachment opening 142 to pass the release loop 160 through, thereby providing a measure of adjustment to the effective length of the waist belt element 140 and the overall fit of the releasable vest 100.

The release lanyard 115 comprises an elongate piece of material having a relatively thin profile. By utilizing a release lanyard 115 having a relatively thin profile, the possibility of the release lanyard 115 producing a pressure point on the user is greatly reduced. However, it should be appreciated that the release lanyard 115 may have a round or oval shaped profile. In various exemplary embodiments, the release lanyard 115 comprises a material having a relatively low coefficient of drag.

In various exemplary embodiments, the release lanyard 115 may comprise a single piece of material that extends from a pull handle 115' to a terminal end. Alternatively, the release lanyard 115 may comprise a variety of materials that are attached or coupled together to form the release lanyard 115. For example, the elongate body portion of the release lanyard 115 may be comprised of a different material from a pull handle 115'.

In various exemplary embodiments, a portion of the exterior of the front panel 110, the back panel 120, and/or the waist belt elements 140 and 140' includes MOLLE and/or S.T.R.I.K.E. compatible webbing. However, it should be appreciated that the inclusion of any such MOLLE and/or S.T.R.I.K.E. compatible webbing is a design choice based on the desired appearance and functionality of the releasable vest 100.

Figure 3C:
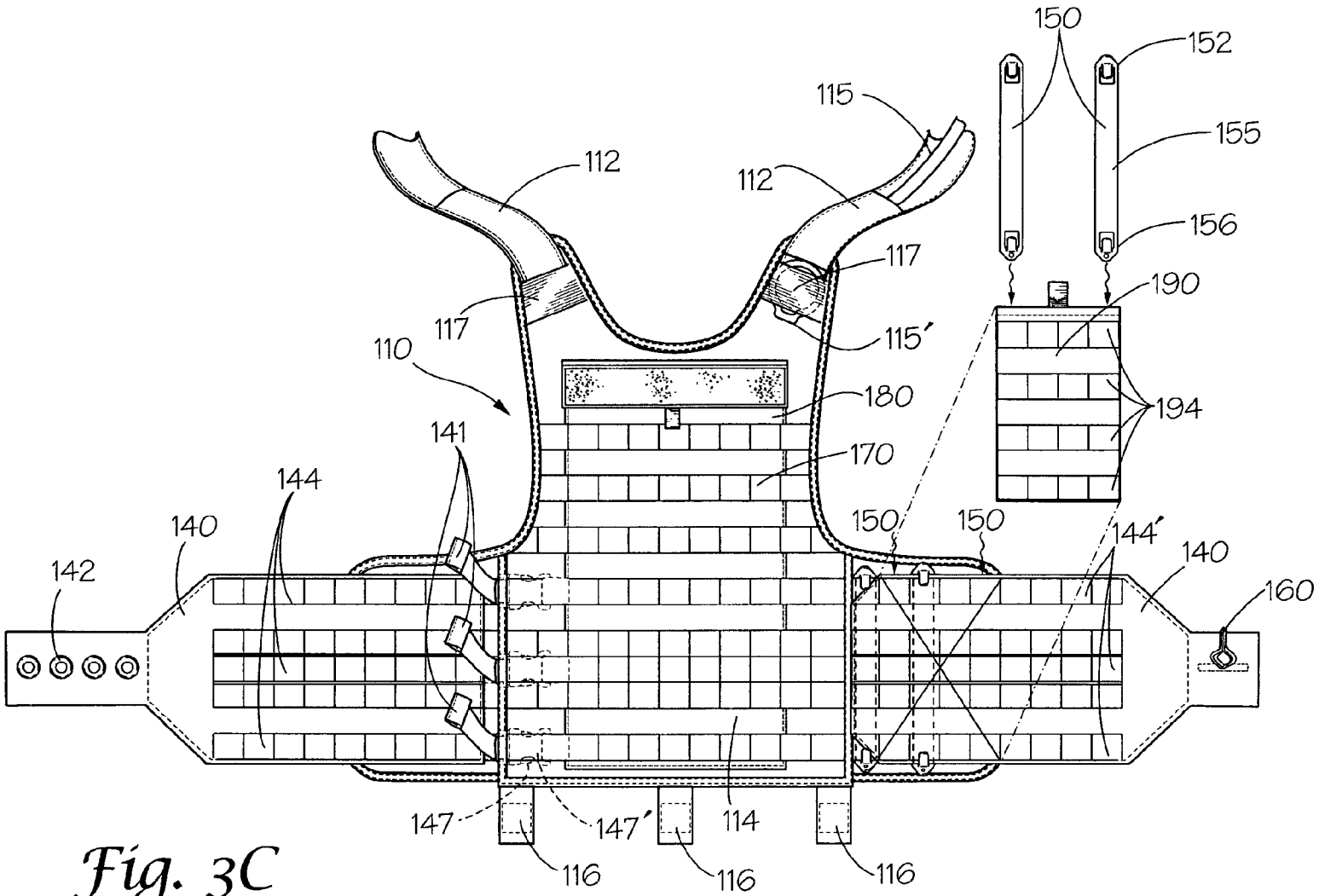
FIG. 3C shows a front view of a the assembled a front panel and waist belt elements of a first exemplary embodiment of a releasable vest, illustrating the front panel flap in a closed position, according to this invention.
Figure 5:
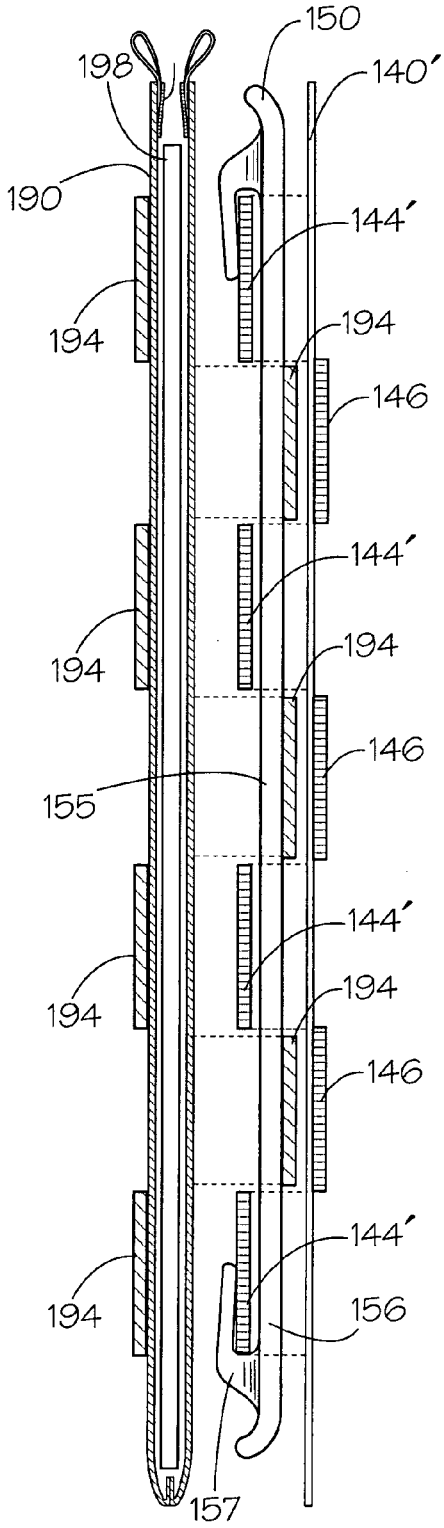
FIG. 5 shows a cross sectional view of an exemplary embodiment of a coupling member used to removably attach an armor plate carrier to a waist belt element, according to this invention.

If, as illustrated herein, the waist belt elements 140 and 140' include MOLLE and/or S.T.R.I.K.E. compatible webbing 144 and 144', respectively, an accessory pouch or carrier, such as, for example, an armor plate carrier 190 for holding an armor plate 198 may be coupled to one or both of the waist belt elements 140 and 140'. As illustrated in FIGS. 3C and 5, an armor plate carrier 190 may be coupled, via coupling members 150, to the waist belt element 140'. As illustrated, the armor plate carrier 190 is placed adjacent the waist belt element 140', such that waist belt webbings 144' are within the spaces between spaced apart armor plate carrier webbings 194 (and the armor plate carrier webbings 194 are within spaces between the spaced apart waist belt webbings 144') and corresponding plate carrier tunnel segments and waist belt tunnel segments are aligned, the coupling member 150 may be interwoven between the aligned plate carrier tunnel segments and waist belt tunnel segments to removably couple the waist belt element 140' to the armor plate carrier webbing 194, similarly to the method described above with reference to FIGS. 3A and 4.

It should be appreciated that while the armor plate carrier 190 is illustrated as being coupled to a second side of the waist belt element 140', the armor plate carrier 190, or any other accessory or accessory carrier, may be coupled to any portion of MOLLE and/or S.T.R.I.K.E. compatible webbing on the releasable vest 100. For example, the armor plate carrier 190 may be coupled to the MOLLE and/or S.T.R.I.K.E. compatible accessory mounting portion 170' included on the second side of the first layer 111, such that the armor plate carrier 190 is coupled between the front panel 110 and the waist belt element 140 or the waist belt element 140'.

In various exemplary embodiments, the front panel 110, the back panel 120, and/or the waist belt elements 140 and 140' may include a pocket or plate carrier, such as, for example, a front pocket 180 and/or a back pocket 182. However, it should be appreciated that the inclusion of any such pocket or plate carrier is a design choice based on the desired appearance and functionality of the releasable vest 100.

If the back pocket 182 is included, the grommet 125 may serve as a drain hole for the back pocket 182. Additionally, if the front pocket 180 and/or additional waist belt elements 140 and 140' include one or more pockets, additional grommets, not show may be included to provide drainage for each of the pockets.

One optional method for assembling the elements of the releasable vest 100 includes first securing the waist belt elements 140 and 140' to the front panel 110, as discussed above.

Figure 9A:
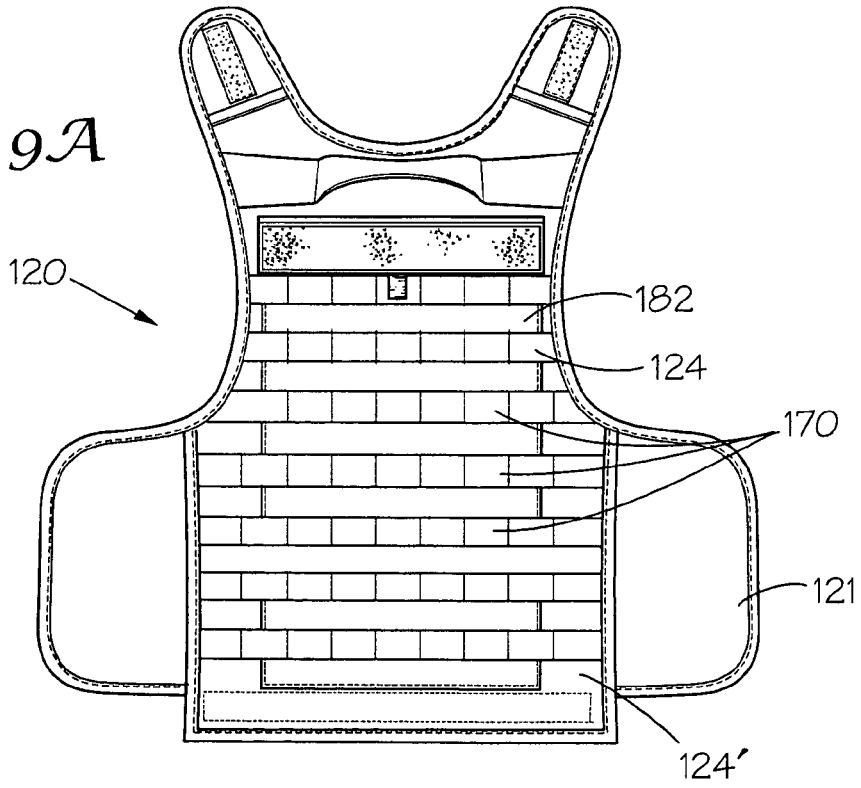
FIG. 9A shows a front view of the back panel of the releasable vest, illustrating the back panel flap in a partially closed position.
Figure 9B:
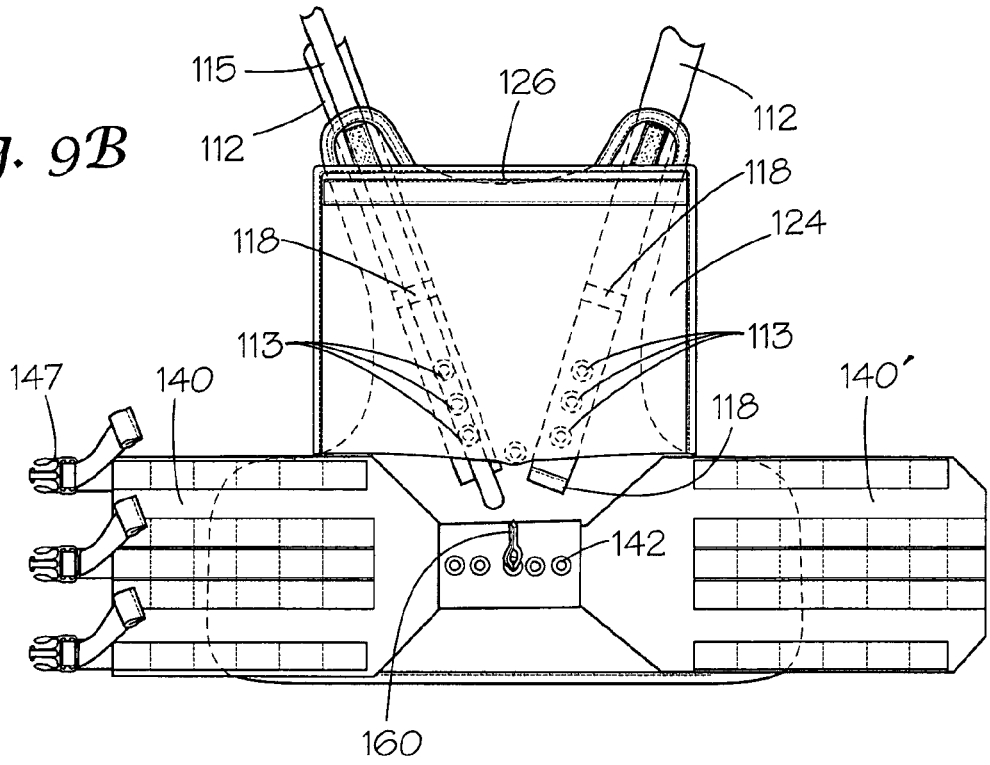
FIG. 9B shows an interior view of the back panel of a first exemplary embodiment of a releasable vest according to this invention, illustrating the back panel flap in an open position and illustrating the releasable coupling of the waist belt elements according to this invention.
Figure 9C:
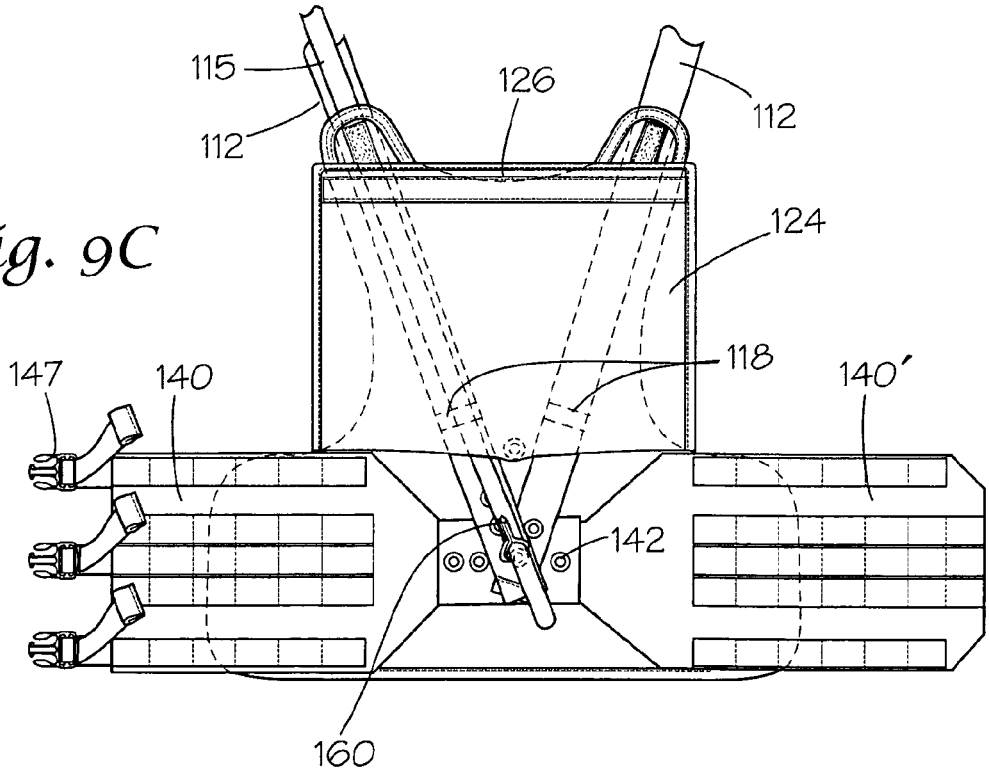
FIG. 9C shows an interior view of the back panel of a first exemplary embodiment of a releasable vest according to this invention, illustrating the back panel flap in an open position and illustrating the releasable coupling of the shoulder strap elements according to this invention.
Figure 10A:
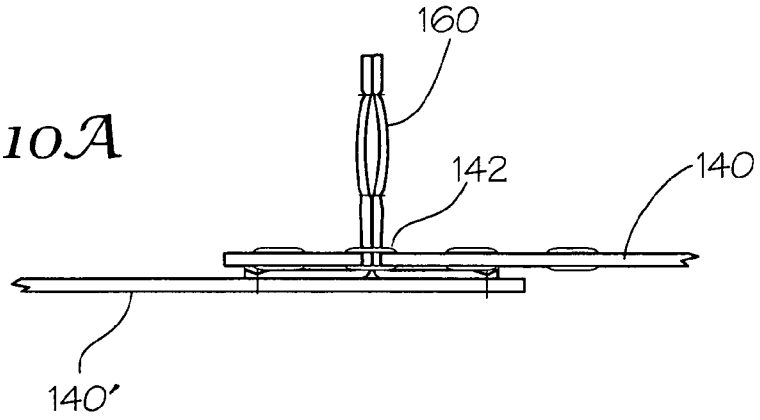
FIG. 10A illustrates a more detailed view of the slidably releasable coupling of the release loop to the waist belt elements according to this invention.
Figure 10B:
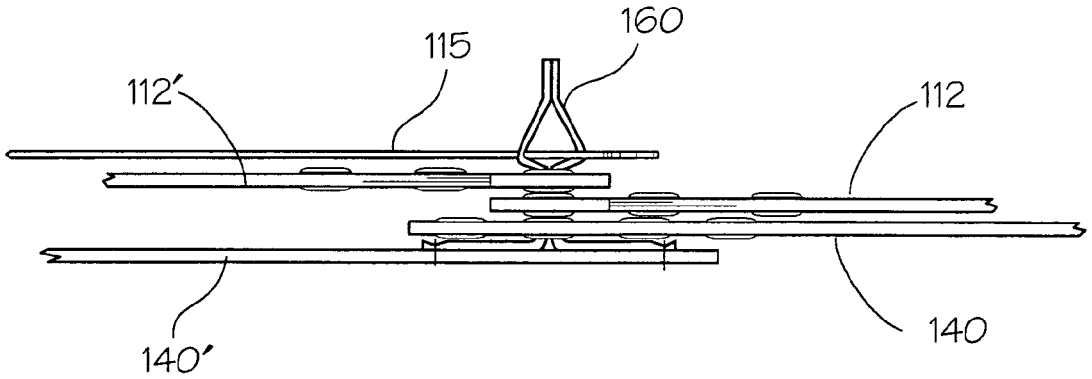
FIG. 10B illustrates a more detailed view of the slidably releasable coupling of the waist belt elements, shoulder strap elements, and release lanyard to the release loop according to this invention.

Then, as illustrated in FIGS. 9A through 10B such, the back panel flap portion 124' is lifted and the waist belt elements 140 and 140' are positioned atop the lower portion of the first layer 121, such that the release loop 160 of the first waist belt element 140 (identified in FIGS. 10A and 10B as waist belt element 140') can be aligned with and passed through the appropriate waist belt attachment opening 142 of the remaining waist belt element 140 (identified in FIGS. 10A and 10B as waist belt element 140).

As illustrated in FIGS. 9B and 10B, when the release loop 160 has been passed through the aligned waist belt attachment opening 142, an end of a first front shoulder strap element 112 is introduced into an interior tunnel or cavity of the back panel 120 and passed through the tunnel or cavity of the back panel 120 such that the release loop 160 can be aligned with and passed through an appropriate front shoulder strap attachment opening 113.

When an appropriate front shoulder strap attachment opening 113 has been aligned with the release loop 160, the release loop 160 is passed through the aligned front shoulder strap attachment opening 113.

Once the release loop 160 has been passed through a front shoulder strap attachment opening 113 of a first front shoulder strap element 112 (identified in FIG. 10B as first shoulder strap element 112), an end of a second front shoulder strap element 112 is passed through an interior tunnel or cavity of the back panel 120 and the release loop 160 is passed through an appropriately aligned front shoulder strap attachment opening 113 of the second front shoulder strap element 112 (identified in FIG. 10B as second shoulder strap element 112').

When the release loop 160 has been passed through the desired waist belt attachment opening 142 of the waist belt elements 140 and 140' and the desired front shoulder strap attachment openings 113 of the front shoulder strap elements 112 and 112', a portion of the release lanyard 115 is passed through the release loop 160 to secure the waist belt elements 140 and 140' and the front shoulder strap elements 112 and 112' together, as illustrated in FIGS. 9C and 10B.

In various exemplary embodiments, the release lanyard 115 follows a path that parallels the path taken by one of the front shoulder strap elements 112. To maintain an appropriate position of the release lanyard 115, release lanyard guides, such as, for example, release lanyard guides 118, may be included on various portions of the front shoulder strap elements 112. Alternatively, similar release lanyard guides may be included in the interior of the back panel 120, attached or couple to either the first layer 121 or the second layer 124.

In various exemplary embodiments, the release lanyard 115 is of a sufficient length such that when the releasable lanyard 115 is passed through the release loop 160, the pull handle 115' is at least partially covered by a release lanyard cover 117. The release lanyard cover 117 provides at least some measure of security that the release lanyard 115 is not accidentally pulled.

In various exemplary embodiments, at least a portion of the release lanyard 115 includes a frictional surface (not shown). The frictional surface, if included, can provide a certain amount of resistance to the release lanyard 115 being pulled from the releasable vest 100 and/or the release lanyard cover 117, when the releasable vest 100 is fully assembled.

It should be appreciated that the order in which the components of the releasable vest 100 are described as being assembled may be altered so that a user is able to achieve the best fit of the releasable vest 100. For example, as described in shown herein, the release loop 160 may be releasably coupled to the remaining waist belt element 140 before the release loop 160 is releasably coupled to the shoulder strap elements 112. Alternatively, the release loop 160 may first be releasably coupled to the shoulder strap elements 112 before the release loop 160 is releasably coupled to the remaining waist belt element 140.

When the waist belt elements 140 and 140' and the shoulder strap elements 112 and 112' have been releasably coupled, via the releasable lanyard 115, to the releasable loop 160, the back panel flap portion 124' is closed and secured, via releasable coupling means 126, to the first layer 121.

Because the assembled combination of the waist belt elements 140 and 140' and the shoulder strap elements 112 is relatively free-floating with respect to the back panel 120, the grommet 125, if included, may provide an upper limit for the assembled combination of the waist belt elements 140 and 140' and the shoulder strap elements 112, such that these elements may be held in a desired position relative to the back panel 120.

When the elements of the releasable vest 100 have been assembled, the assembled releasable vest 100 may be donned or removed by a user utilizing the waist belt attachment/adjustment elements 145. Alternatively, if the waist belt elements 140 and/or 140' are formed integral to the front panel 110, an elastic portion of the waist belt elements 140 and/or 140' may provide sufficient flex to allow the releasable vest 100 to be donned or removed by the user.

If a wearer wishes to quickly remove the releasable vest 100, the releasable lanyard 115 need only be pulled a relatively short distance. When the pull handle 115' of the releasable lanyard 115 is pulled, the release lanyard 115 is slidably pulled from the release loop 160, and the waist belt elements 140 and 140' and front shoulder strap elements 112 are able to separate from the release loop 160, and the back panel 120. Thus, when the pull handle 115' is pulled, the elements of the releasable vest 100 are released and the vest can "fall away" from the body of the user.

In various exemplary embodiments, the releasable vest 100 may further comprise a second, safety lanyard (not shown), which may also be slidably passed through the release loop 160. The safety lanyard operates similarly to the release lanyard 115. However, the safety lanyard, if utilized, requires that a second obstruction be removed from the release loop 160 before the elements of the releasable vest 100 are able to separate from the release loop 160.

In certain exemplary embodiments, the safety lanyard may comprise a loop of material or a ring, such as, for example, a locking or snap carabiner, that is slidably passed through the release loop 160 after the elements of the releasable vest 100 have been slidably releasably coupled to the release loop 160. In various exemplary embodiments, release of the safety lanyard may require access through the back panel flap portion 124'.

It is possible that a safety lanyard be used in place of the release lanyard 115. In this manner, the releasable features and capabilities of the vest are overcome and the elements remain coupled until the safety lanyard is removed.

In various exemplary embodiments, instructions for assembling and/or operating the releasable vest 100 may be included on the first layer 121 or on an inside layer or surface of the back panel flap portion 124'. In this manner, when the back panel flap portion 124' is lifted so that a user is able to assemble the components of the releasable vest 100, instructions for the assembly and/or operation of the releasable vest 100 are provided. The instructions may be provided in written, pictorial, diagram, or a combination of forms.

Alternatively, instructions for assembling and/or operating the releasable vest 100 may be included on the second layer 124 of the back panel 120. The instructions may be provided in written, pictographic, diagram, symbolic, or a combination of forms and may, for example, include a pictorial outline of certain of the components illustrating the relationship of each of the components when assembled or illustrating how the components are to be assembled.

While optional instructions have been described as being included on the inside layer or surface of the back panel flap portion 124' or the first layer 121 of the back panel 120, the optional instructions may be included on any covered or exposed surface of any component of the releasable vest 100.

While not illustrated herein, in various exemplary embodiments, the releasable vest 100 may comprises a first release loop 160 and a second release loop 162 (not shown), both of which are attached or coupled to one of the waist belt elements 140 and 140'. It should be appreciated that the first release lanyard 160 and the second release loop 162 (not shown) operate similarly to the release loop 160, as described above.

However, with the inclusion of the second release loop 162 (not shown), certain components may be releasably coupled to the first release loop 160 while certain other components are releasably coupled to the second release loop 162 (not shown). For example, the remaining waist belt element 140 may be releasably slidably coupled to the first release loop 160, while the front shoulder strap elements 112 may be releasably slidably coupled to the second release loop 162 (not shown).

In this manner, the releasable lanyard 115 may be passed through the first release loop 160 and a second release loop 162 (not shown) to secure the front shoulder strap elements 112 and the waist belt elements 140 and 140', respectively.

Utilizing a first release loop 160 and a second release loop 162 (not shown), when the release lanyard 115 is pulled a first distance, the elements of the releasable vest 100 that are coupled to the first release loop 160 are able to separate from the first release loop 160. Then, when the release lanyard 115 is pulled a second distance, the elements of the releasable vest 100 that are coupled to the second release loop 162 (not shown) are able to separate from the second release loop 162 (not shown).

In this manner, certain of the components of the releasable vest 100 are released from the assembled relationship when the release lanyard 115 is pulled a first predetermined distance. When the release lanyard 115 is pulled a second predetermined distance, certain remaining components of the releasable vest 100 are released from the assembled relationship.

If, for example, the release lanyard 115 is accidentally pulled, it is possible that only one of the waistband elements 140 will be released from the second release loop 162 (not shown), alerting the user to the fact that the release lanyard 115 has been accidentally pulled, before all of the elements of the releasable vest 100 are released from their assembled relationship.

Figure 11A:
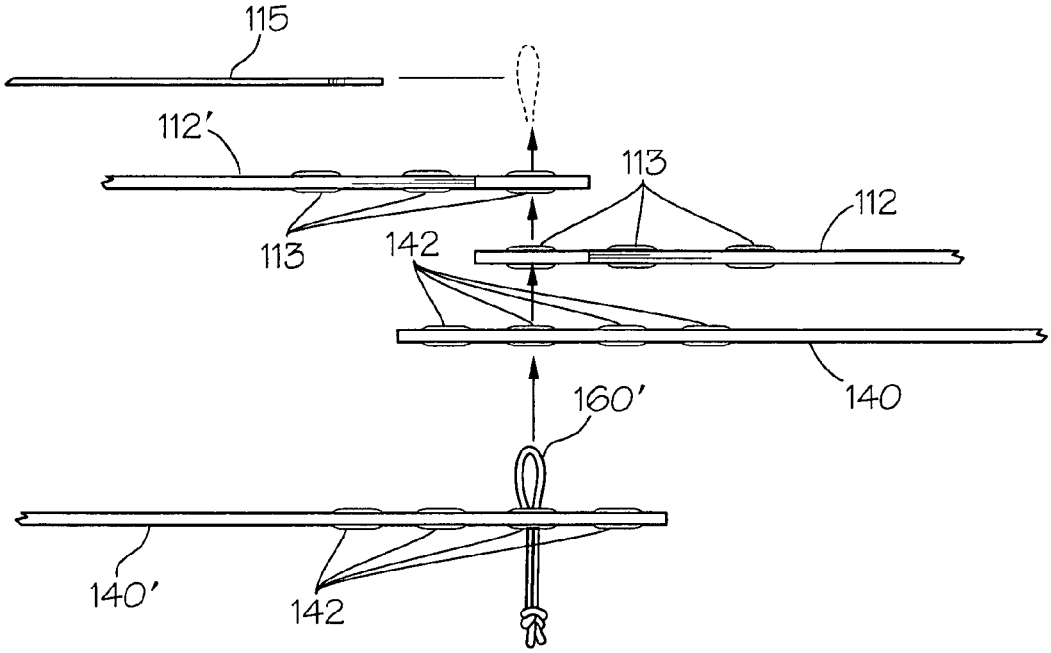
FIG. 11A illustrates a partially exploded view of the slidably releasable coupling according to this invention, utilizing a second exemplary embodiment of a release loop.
Figure 11B:
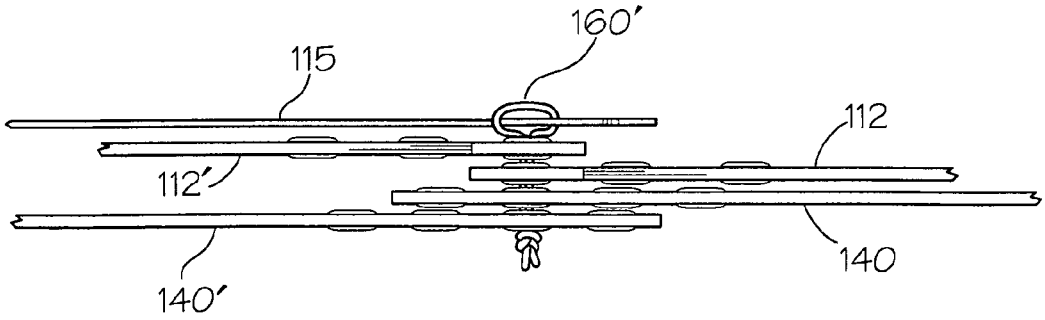
FIG. 11B illustrates an assembled view of the slidably releasable coupling of the waist belt elements, shoulder strap elements, and release lanyard to the second exemplary embodiment of a release loop according to this invention.

FIGS. 11A and 11B show a more detailed view of the slidably releasable coupling of a second exemplary embodiment of a release loop 160' to the waist belt elements according to this invention. As illustrated in FIGS. 11A and 11B, the release loop 160' is not attached or coupled to one of the waist belt element 140 or the waist belt element 140'. Instead, the release loop 160' comprises a separate component. As illustrated, the release loop 160' may comprise a loop of material, such as, for example, 550 cord, that is tied in a knot proximate the ends of the material. The knot or other obstruction formed in the release loop 160' is of a sufficient size and shape so as to be kept from passing through the waist belt attachment openings 142.

In these exemplary embodiments, both the waist belt element 140 and the waist belt element 140' include one or more waist belt attachment opening(s) 142. During assembly, the appropriate waist belt attachment openings 142 and the appropriate front shoulder strap attachment openings 113 are aligned and the release loop 160' is passed through the aligned waist belt attachment openings 142 and front shoulder strap attachment opening 113. Once a portion of the release loop 160' has passed through the openings, sufficient that a portion of the release lanyard 115 may be passed through the release loop 160' to secure the waist belt elements 140 and 140' and the front shoulder strap elements 112 and 112' together, the release loop 160' is maintained in position via the release lanyard 115 and the knot or other obstruction formed in the release loop 160'.

Figure 12:
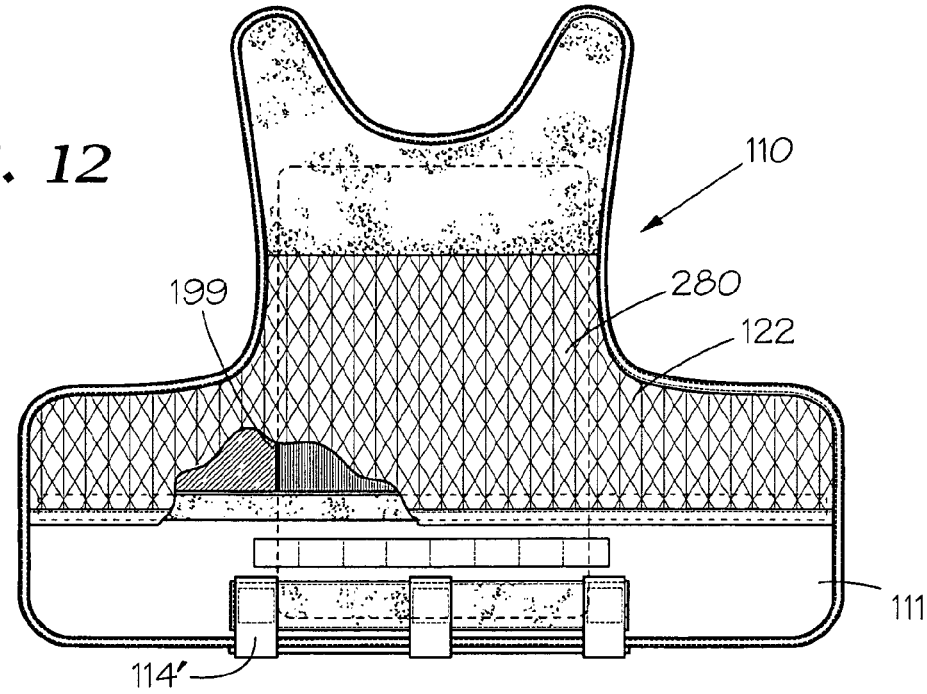
FIG. 12 shows a rear view of the front panel of an exemplary embodiment of the releasable vest, wherein the front panel includes an internal pocket.
Figure 13:
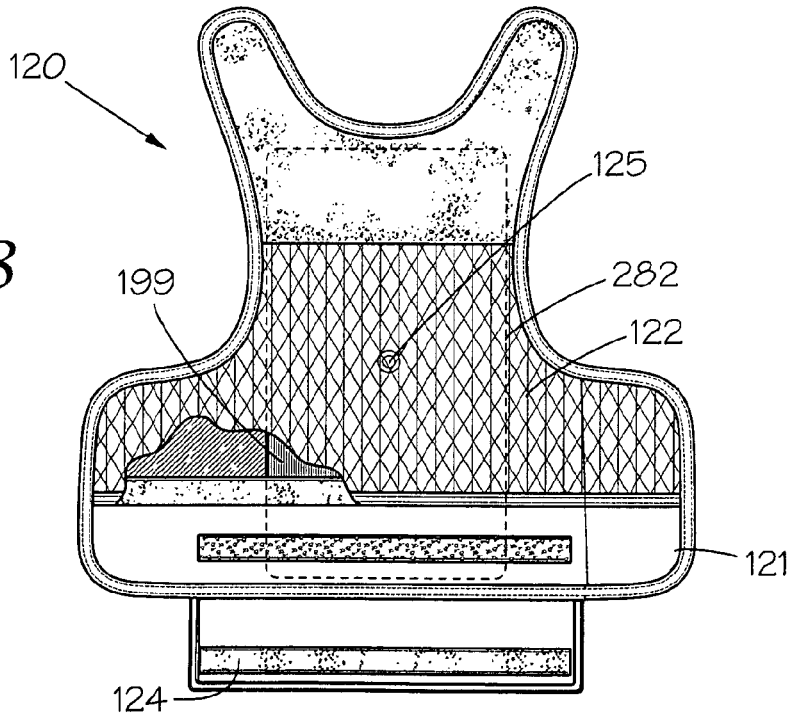
FIG. 13 shows a rear view of the back panel of an exemplary embodiment of the releasable vest, wherein the back panel includes an internal pocket.

FIGS. 12 and 13 show exemplary embodiments of a releasable vest wherein the exemplary front pocket 180 and back pocket 182 are replaced or supplemented by a front internal pocket 280 and a back internal pocket 282, respectively. In these exemplary embodiments, the first layer 111 of the front panel 110 comprises a front internal pocket 280, which is accessible when the front panel flap portion 114' of the second layer 114 is opened. Likewise, the first layer 121 of the back panel 120 comprises a back internal pocket 282, which is accessible when the back panel flap portion 124' of the second layer 124 is opened.

Items, such as, for example, body armor plates 199 may be inserted in the front internal pocket 280 and/or the back internal pocket 282. Once the items are inserted, the front panel flap portion 114' and/or the back panel flap portion 124' can be closed to secure the items within the front internal pocket 280 and/or the back internal pocket 282.

It should be appreciated that the inclusion of any external and/or internal pocket or plate carrier is a design choice based on the desired appearance and functionality of the releasable vest 100.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, is intended to be illustrative, not limiting. Various changes, modifications, and/or adaptations may be made without departing from the spirit and scope of this invention.

What is claimed is:

1. A releasable vest, comprising:

a front panel;

shoulder strap elements that extend from the front panel, wherein each of the shoulder strap elements includes at least one shoulder strap attachment opening formed therethrough;

a back panel comprising at least a first layer and a second layer, wherein an upper portion of the second layer of the back panel is attached to the first layer of the back panel such that a cavity is formed between at least a portion of the first layer of the back panel and the second layer of the back panel;

at least one coupling means coupling the first layer of the back panel to the second layer of the back panel;

a first waist belt element attached or coupled to the front panel, wherein the first waist belt element comprises at least one waist belt element attachment opening formed therethrough;

a second waist belt element attached or coupled to the front panel, wherein the second waist belt element comprises at least one waist belt element attachment opening formed therethrough;

a front panel comprising at least a first layer and a second layer, wherein an upper portion of the second layer of the front panel is attached to the first layer of the front panel;

a release loop comprising a portion of material that includes an obstruction that is of a sufficient size and shape so as to keep a portion of the release loop from passing through the waist belt attachment openings of the first waist belt element and the second waist belt element, wherein the release loop is detached from the back panel, wherein the release loop does not pass through the back panel, and wherein at least a portion of the release loop is capable of passing through the at least one waist belt attachment opening of the waist belt elements and the at least one shoulder strap attachment opening of the shoulder strap elements; and a release lanyard, wherein the release lanyard is capable of passing through the release loop.

2. The releasable vest of claim 1, wherein the first waist belt element is releasably attached to the front panel via a mating pair of coupling elements.

3. The releasable vest of claim 1, wherein the second waist belt element is removably coupled, via one or more coupling members, to MOLLE or S.T.R.I.K.E. compatible accessory mounting portions formed on the front panel.

4. The releasable vest of claim 1, wherein the obstruction is a knot formed in a length of material.

5. The releasable vest of claim 1, wherein the second waist belt element is attached or coupled to a lower portion of the front panel.

6. The releasable vest of claim 1, wherein the second waist belt element is removably attached or coupled to a lower portion of the front panel.

7. The releasable vest of claim 1, wherein the shoulder strap elements extend from an upper portion of the front panel.

8. The releasable vest of claim 1, wherein the first waist belt element is attached or coupled to a lower portion of the front panel.

9. The releasable vest of claim 1, wherein the first waist belt element is releasably attached or coupled to a lower portion of the front panel.

10. The releasable vest of claim 1, wherein the at least one coupling means comprises a releasable coupling means.

11. The releasable vest of claim 1, wherein the at least one coupling means comprises a grommet, a stitch or stitched portion, one or more male/female snap-release buckles, one or more buttons, one or more snaps, one or more fasteners, one or more closure means, or one or more attachment means.

12. The releasable vest of claim 1, wherein the at least one coupling means provides an upper limit for an assembled combination of the first waist belt element, the second waist belt element, and the shoulder strap elements, such that the assembled combination of the first waist belt element, the second waist belt element, and the shoulder strap elements may be held in a desired position between the first layer of the back panel and the second layer of the back panel.

13. The releasable vest of claim 1, wherein a lower portion of the second layer of the back panel extends beyond an area where the second layer of the back panel is attached or coupled to the first layer of the back panel to form a back access panel portion.

14. The releasable vest of claim 1, wherein a lower portion of the second layer of the front panel extends beyond an area where the second layer of the front panel is attached or coupled to the first layer of the front panel to form a front access panel portion.

15. The releasable vest of claim 1, wherein at least a portion of the shoulder strap elements can be introduced into the cavity formed between at least a portion of the first layer of the back panel and the second layer of the back panel.

16. The releasable vest of claim 1, wherein the release lanyard is capable of passing through the release loop so as to releasably secure the first waist belt element, the second waist belt element, and the shoulder strap elements to the release loop.

17. The releasable vest of claim 1, wherein the release loop comprises a fabric, metallic, plastic, or composite material.

18. The releasable vest of claim 1, wherein at least one of the waist belt elements is attached or coupled to a portion of the front panel.

19. The releasable vest of claim 1, wherein at least one of the front shoulder strap elements is attached or coupled to a portion of the front panel.

* * * * *